US010465916B2

(12) United States Patent
Park

(10) Patent No.: US 10,465,916 B2
(45) Date of Patent: Nov. 5, 2019

(54) KITCHEN BOX FOR CAMPING

(71) Applicant: SoonGyu Park, Yongin-si (KR)

(72) Inventor: SoonGyu Park, Yongin-si (KR)

( * ) Notice: Subject to any disclaimer, the term of this patent is extended or adjusted under 35 U.S.C. 154(b) by 226 days.

(21) Appl. No.: 15/623,278

(22) Filed: Jun. 14, 2017

(65) Prior Publication Data

US 2018/0363920 A1 Dec. 20, 2018

(51) Int. Cl.

| | |
|---|---|
| ***F24C 5/20*** | (2006.01) |
| ***F24C 3/14*** | (2006.01) |
| ***A47B 3/10*** | (2006.01) |
| ***A47B 37/04*** | (2006.01) |
| *A47B 77/10* | (2006.01) |

(52) U.S. Cl.

CPC ..... *F24C 3/14* (2013.01); *A47B 3/10* (2013.01); *A47B 37/04* (2013.01); *A47B 77/10* (2013.01)

(58) Field of Classification Search

CPC ... A45C 11/20; F24C 5/20; F24C 3/14; F24C 15/18

See application file for complete search history.

(56) References Cited

U.S. PATENT DOCUMENTS

| | | | | |
|---|---|---|---|---|
| 2,213,985 | A * | 9/1940 | Howe | B41J 29/06 190/11 |
| 3,559,633 | A * | 2/1971 | Born | F24C 3/14 126/38 |
| 2003/0010332 | A1* | 1/2003 | Mosher | F24C 3/085 126/38 |
| 2005/0211581 | A1* | 9/2005 | King | A45C 13/03 206/288 |
| 2006/0137379 | A1* | 6/2006 | Cawthon | A22C 17/08 62/285 |
| 2006/0144386 | A1* | 7/2006 | Cho | F24C 3/14 126/38 |
| 2014/0116413 | A1* | 5/2014 | Brown | A45F 3/46 126/276 |

FOREIGN PATENT DOCUMENTS

| | | | |
|---|---|---|---|
| KR | 2014-0065758 | A | 5/2014 |
| KR | 20-0473931 | Y1 | 8/2014 |

* cited by examiner

*Primary Examiner* — Jason Lau
(74) *Attorney, Agent, or Firm* — Weaver Austin Villeneuve & Sampson LLP

(57) ABSTRACT

A kitchen box for camping in which various types of camping equipment are installed or accommodated and a collapsible table is provided. The kitchen box for camping includes a case which accommodates camping equipment, and one or more plates connected to the case and may be folded or unfolded, such that the kitchen box for camping may be convenient, may be easily installed, and may provide a wide space.

12 Claims, 6 Drawing Sheets

KITCHEN BOX FOR CAMPING

BACKGROUND

Field

The present disclosure relates to a kitchen box for camping, and more particularly, to a kitchen box for camping in which various types of outdoor kitchen utensils required to cook and eat food during outdoor activity are installed or accommodated in a single box, including a collapsible table.

Description of the Related Art

Recently, demands for various types of camping equipment have increased as interest in camping is rapidly increased. In general, as the camping equipment widely purchased and used by consumers, there are tents, cookware for camping, outdoor tables and chairs, and the like.

In addition, there is a chuck box as camping equipment that recently and gradually attracts customers' attention. The chuck box is camping equipment that may accommodate cookware used for camping, and foodstuffs, and may also be used as a table. The chuck box is camping equipment that can be usefully used for camping in cooking and eating environments that are poor, when cooking and eating food outdoors, and when it is difficult to accommodate cookware and foodstuffs.

In general, the chuck box in the related art is configured such that supports stand on the ground, an accommodating chamber is placed on the supports, and a table is placed in front of the accommodating chamber. The chuck box has a problem in that users need to separately carry the respective constituent elements, one by one, such as the supports, the accommodating chamber, and the table which constitute the chuck box. In addition, there is a problem in that available accommodating, cooking, and eating spaces are not sufficient in comparison with a size of the chuck box itself.

Accordingly, there is a need for a kitchen box which may be conveniently carried, and may sufficiently accommodate camping equipment and have sufficient cooking and eating spaces.

SUMMARY

The present disclosure provides a kitchen box for camping, which includes a case which accommodates camping equipment, and one or more plates connected to the case and may be folded or unfolded, such that the kitchen box for camping may be convenient, may be easily installed, and may provide a wide space.

Technical problems of the present disclosure are not limited to the aforementioned technical problems, and other technical problems, which are not mentioned above, may be clearly understood by those skilled in the art from the following descriptions.

According to an aspect of the present disclosure, there is provided a kitchen box for camping including: a case which is formed with an accommodation space therein and has an opening; a first plate which is rotatably connected to the case so as to cover at least a part of the opening; a second plate which is rotatably connected to the first plate so as to overlap the first plate; and a support which is fixed to one surface of the second plate, in which the first plate, the second plate, and the case are connected so as to form a first arrangement in which the first plate covers at least a part of the opening and the second plate overlaps the first plate, and a second arrangement in which the first plate does not cover the opening and the first plate and the second plate are unfolded in parallel with each other. Planes formed by the first plate, the second plate, and the opening are formed to be parallel to one another when the first plate, the second plate, and the case form the second arrangement, and the support supports the second plate with respect to the ground surface when the first plate, the second plate, and the case form the second arrangement.

According to some embodiments, the kitchen box may further include: a third plate which is rotatably connected to the second plate so as to overlap the second plate; and a support which is detachably fixed to one surface of the third plate, in which the third plate overlaps the second plate and the support is separated from the third plate when the case, the first plate, and the second plate form the first arrangement. The third plate is unfolded to be parallel to the second plate when the case, the first plate, and the second plate form the second arrangement, and the support is fixed to the third plate and supports the third plate with respect to the ground surface.

According to some embodiments, the case may be provided with a moving handle which is extended and retracted so as to protrude to the outside of the case or to be accommodated in the case, and wheels which are rotatably fixed.

According to some embodiments, the kitchen box may further include a heating device which is mounted on the first plate so as to allow a user to cook food on the first plate when the case, the first plate, and the second plate form the second arrangement.

According to some embodiments, the heating device may include: one or more burners; a thermal energy adjusting unit which is configured to adjust thermal energy of the burner; and a fuel supply tube which is connected to a portable gas tank and configured to supply fuel to the burner.

According to the feature of the present disclosure, the kitchen box may further include a windshield partition which is installed at an edge of the first plate so as to surround the burner.

According to some embodiments, the kitchen box may further include a fourth plate which is detachably installed on the case such that the fourth plate overlaps the third plate when the case, the first plate, the second plate, and the third plate form the first arrangement, and the fourth plate is separated from the third plate when the case, the first plate, the second plate, and the third plate form the second arrangement.

According to some embodiments, the kitchen box may further include a rotary hanger which is rotatably connected to the case so as to be unfolded in a direction opposite to a direction in which the first plate is unfolded when the first plate, the second plate, and the case form the second arrangement.

According to some embodiments, the case may be provided with a sink which is detachably fixed to the case so as to cover at least a part of the opening.

According to some embodiments, all of the equipment or tools such as burners, tables, pots, frying pans, various types of bowls, knives, kitchen boards, fuel, spoons, forks, lighting devices, and chairs, which are required to cook and eat food outdoors, are implemented as a single box, and as a result, it is possible to cook and eat food during camping, and it is possible to ensure sufficient cooking and eating spaces.

In addition, according to some embodiments, it is possible to provide the kitchen box for camping that includes one or more plates which are connected to the case and may be folded or unfolded, such that the kitchen box for camping may be convenient, may be easily installed and disassembled, and may provide a wide space.

In addition, according some embodiments, the wheels and the handle are provided, and as a result, the kitchen box for camping may be conveniently moved in a state in which the camping equipment is accommodated in the accommodation space.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
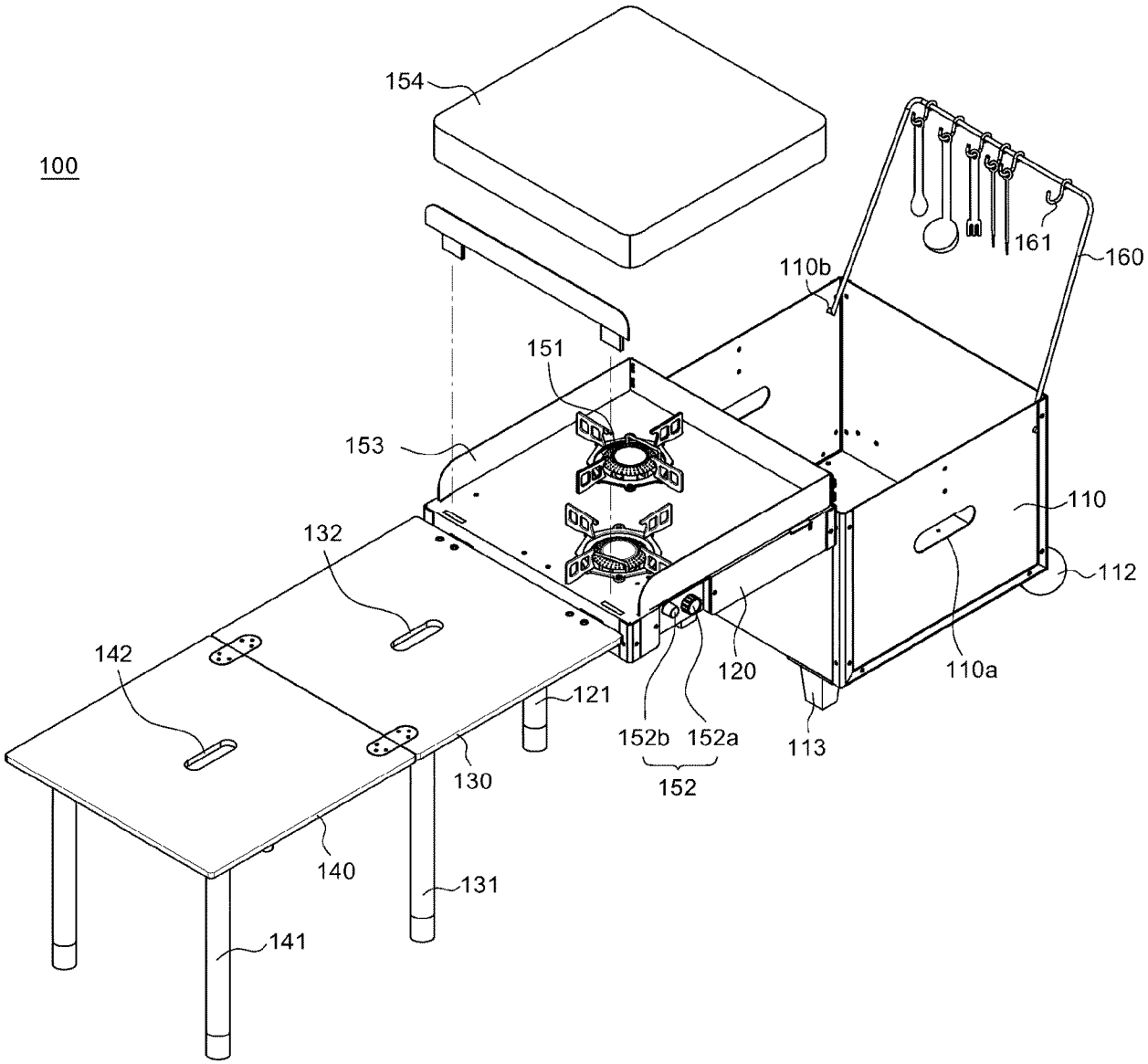
FIG. 1 is a schematic perspective view of a kitchen box for camping according to an exemplary embodiment of the present disclosure.

Advantages and features of the present disclosure and methods of achieving the advantages and features will be clear with reference to exemplary embodiments described in detail below together with the accompanying drawings. However, the present disclosure is not limited to exemplary embodiment disclosed herein but will be implemented in various forms. The exemplary embodiments are provided so that the present disclosure is completely disclosed, and a person of ordinary skilled in the art can fully understand the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is referred to as being "on" another element or layer, it can be directly on the other element or layer or intervening elements or layers may also be present. Throughout the specification, the same reference numerals denote the same constituent elements.

Terms "first", "second", and the like may be used to describe various constituent elements, but the constituent elements are not limited by these terms. These terms are used only to distinguish one constituent element from another constituent element. Therefore, the first constituent element mentioned hereinafter may of course be the second constituent element within the technical spirit of the present disclosure.

The size and thickness of each component illustrated in the drawings are shown for ease of description, but the present disclosure is not necessarily limited to the size and thickness of the illustrated component.

Respective features of several exemplary embodiments of the present disclosure may be partially or entirely coupled to or combined with each other, and as sufficiently appreciated by those skilled in the art, various technical cooperation and operations may be carried out, and the respective exemplary embodiments may be implemented independently of each other or implemented together correlatively.

Hereinafter, a kitchen box for camping according to an exemplary embodiment of the present disclosure will be described with reference to the accompanying drawings.

Figure 2:
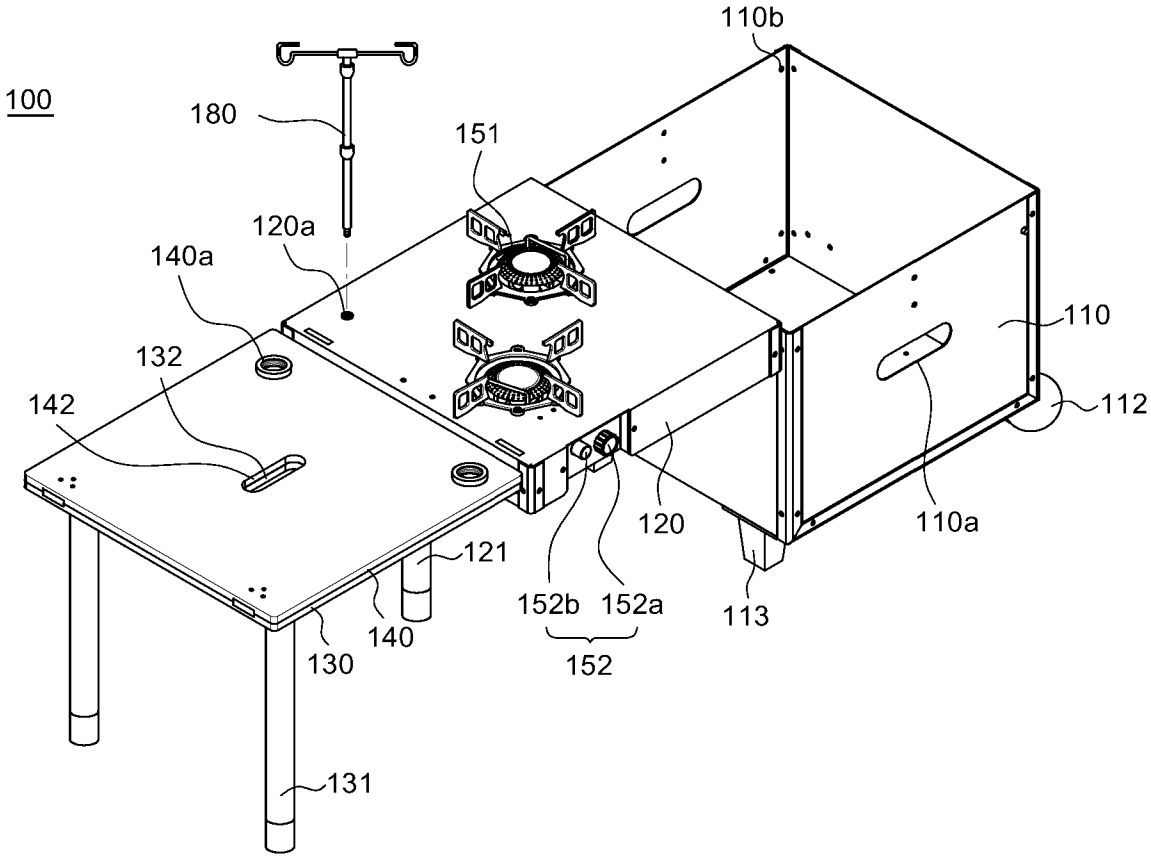
FIGS. 2, 3 and 4 are schematic perspective views illustrating states according to a process of installing the kitchen box for camping in FIG. 1.
Figure 3:
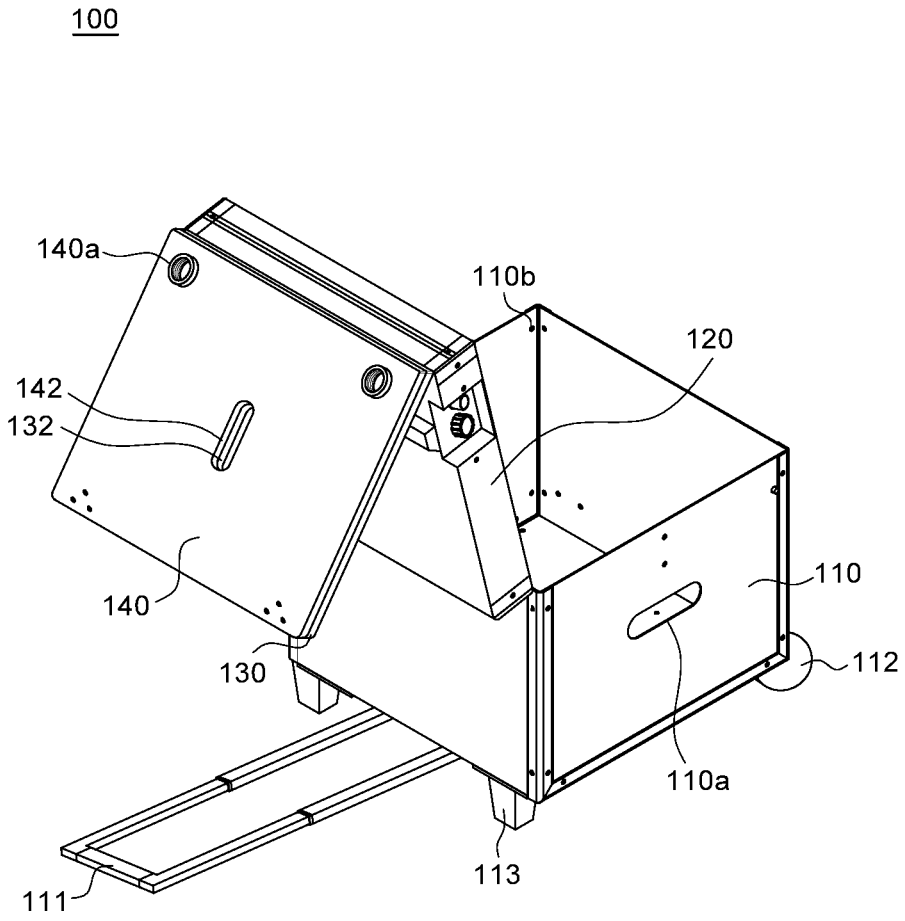
Figure 4:
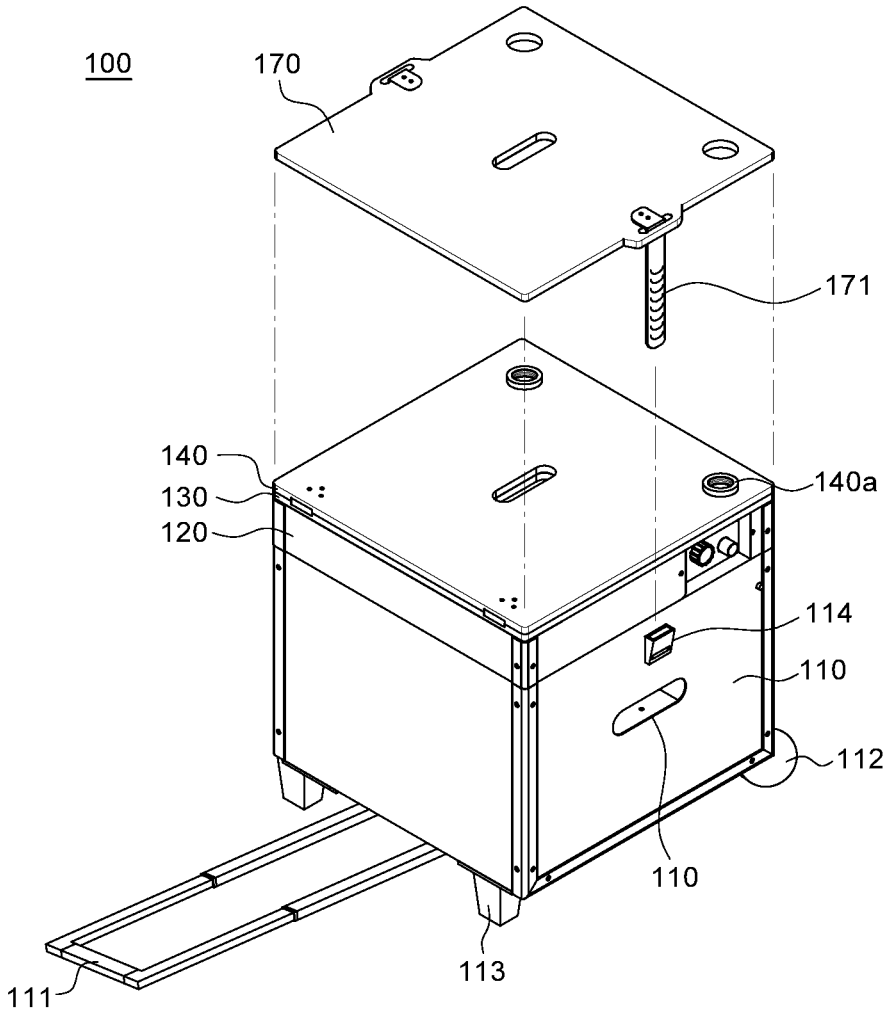

FIG. 1 is a schematic perspective view of a kitchen box for camping according to an exemplary embodiment of the present disclosure, and FIGS. 2, 3, and 4 are schematic perspective views illustrating states according to a process of installing the kitchen box for camping in FIG. 1.

Referring to FIG. 1, a kitchen box 100 for camping according to the present disclosure includes a case 110, a first plate 120, a second plate 130, a third plate 140, a heating device 150 mounted on the first plate, and a rotary hanger 160.

The respective constituent elements of the present disclosure will be described as being placed in a state as illustrated in FIG. 1. In addition, in the following description, a floor surface on which the kitchen box of the present disclosure is placed is referred to as a 'ground surface'.

The case 110 is formed with an accommodation space therein and has an opening. The case 110 includes a bottom surface and sidewalls which surround the bottom surface, and the case 110 has the opening at an upper side thereof and has the accommodation space formed therein. The case 110 may accommodate various types of camping equipment, foodstuffs required for camping, cookware, and various items required to cook food, and other useful equipment for camping may be installed in the case 110.

Handle holes 110*a* may be formed at both sides of the case 110 in order to enable a user to hold and lift up the kitchen box 100 for camping by hand when the user loads the kitchen box onto a vehicle or carries the kitchen box on the stairs or the like. However, unlike the configuration illustrated in the drawings, the handle holes 110*a* may be formed in surfaces other than central portions at both sides of the case 110, or may be formed at other positions.

The accommodation space in the case 110 may be freely divided by a separately provided partition. The partition may be completely fixed to the case 110, but the partition may be detachably fixed to the case 110, such that the divided space is freely changed depending on a size of an item to be accommodated, thereby improving utilization of the accommodation space.

The first plate 120 is rotatably connected to the case 110 so as to cover at least a part of the opening of the case 110. One end portion of the first plate 120 may be hingedly connected to an upper end portion of the sidewall of the case 110.

The first plate 120 may be folded toward the case 110 to cover the opening of the case 110, or may be unfolded to be parallel to a plane defining the opening of the case 110 without covering the opening. In this instance, a rotation of the first plate 120 may be restricted in order to prevent the first plate 120 from being excessively unfolded.

Meanwhile, the first plate 120 may be formed to cover the entire opening of the case 110 as illustrated in FIGS. 1 through 4. However, although not illustrated, the first plate 120 may be formed to be smaller than the opening so as to cover only a part of the opening.

One or more supports 121 may be provided on a lower surface of the first plate 120. The support 121 may be configured to be detachably installed to the lower surface of the first plate 120. In this instance, one end portion of the support 121 is inserted into a fixing groove formed in the lower surface of the first plate 120, such that the support 121 may be installed to be perpendicular to the lower surface of the first plate 120 or installed to have a predetermined angle with respect to the lower surface of the first plate 120. Therefore, the support 121 may securely support the first plate 120 with respect to the ground surface. The support 121 may be disposed at a center of the lower surface of the first plate 120 or may be disposed at an edge of the lower surface of the first plate 120.

The second plate 130 is rotatably connected to the first plate 120 so as to overlap the first plate 120. One end portion of the second plate 130 may be hingedly connected to an end portion of the first plate 120 opposite to the end portion of the first plate 120 which is connected to the case 110.

The second plate 130 may be folded toward the first plate 120 so as to overlap the first plate 120 or may be unfolded to be parallel to the first plate 120 without overlapping the first plate 120. In this instance, a rotation of the second plate 130 may be restricted in order to prevent the second plate 130 from being excessively unfolded with respect to the first plate 120.

Meanwhile, the second plate 130 is connected to the end portion of the first plate 120 opposite to the case 110 as illustrated in FIG. 1, such that the second plate 130 may be unfolded to form a line with the case 110 and the first plate 120, but the second plate 130 may be connected to another end portion of the first plate 120. For example, the second plate 130 may be connected to a lateral end portion of the first plate 120 so that a "¬" shape may be made when the first plate 120 and the second plate 130 are unfolded from the case 110.

One or more supports 131 may be provided on a lower surface of the second plate 130. Similar to the support 121 installed on the first plate 120, the support 131, which is to be installed on the second plate 130, may also be configured to be detachably installed on the lower surface of the second plate 130. In other words, one end portion of the support 131 is inserted into a fixing groove formed in the lower surface of the second plate 130, such that the support 130 may be installed to be perpendicular to the lower surface of the second plate 130 or installed to have a predetermined angle with respect to the lower surface of the second plate 130. Therefore, the support 131 may securely support the second plate 130 with respect to the ground surface, and the support 131 may be disposed at a center of the lower surface of the second plate 130 or may be disposed at an edge of the lower surface of the second plate 130.

The third plate 140 is rotatably connected to the second plate 130 so as to overlap the second plate 130. One end portion of the third plate 140 may be hingedly connected to the other end portion of the second plate 130.

The third plate 140 may be folded toward the second plate 130 so as to overlap the second plate 130 or may be unfolded to be parallel to the second plate 130 without overlapping the second plate 130. In this instance, a rotation of the third plate 140 may be restricted in order to prevent the third plate 140 from being excessively unfolded with respect to the second plate 130.

Meanwhile, the third plate 140 may be connected to the end portion of the second plate 130 opposite to the first plate 120 as illustrated in FIG. 1 so as to be unfolded to form a line with the first plate 120 and the second plate 130, but the third plate 140 may be connected to another end portion of the second plate 130. For example, the third plate 140 may be connected to a lateral end portion of the second plate 130 so that a "¬" may be made when the first plate 120, the second plate 130, and the third plate 140 are unfolded.

One or more supports 141 may be provided on a lower surface of the third plate 140. Similar to the support 121 installed on the first plate 120 and the support 131 installed on the second plate 130, the support 141, which is to be installed on the third plate 140, may also be configured to be detachably installed on the lower surface of the third plate 140. That is, one end portion of the support 141 is inserted into a fixing groove 140*a* formed in the lower surface of the third plate 140, such that the support 141 may be installed to be perpendicular to the lower surface of the third plate 140 or installed to have a predetermined angle with respect to the lower surface of the third plate 140. The support 141 may also be disposed at a center of the lower surface of the third plate 140 or may be disposed at an edge of the lower surface of the third plate 140.

Meanwhile, the support 121 of the first plate 120, the support 131 of the second plate 130, and the support 141 of the third plate 140 are installed such that one end portion of the support 121, one end portion of the support 131, and one end portion of the support 141 are folded toward the first plate 120, the second plate 130, and the third plate 140, respectively, and when one end portion of the support 121, one end portion of the support 131, and one end portion of the support 141 are unfolded, the support 121, the support 131, and the support 141 are installed to be perpendicular to the lower surfaces of the first plate 120, the second plate 130, and the third plate 140, respectively, or installed to have predetermined angles with respect to the lower surfaces of the first plate 120, the second plate 130, and the third plate 140, respectively. In the case in which the supports 121, 131, and 141 are installed to be folded and unfolded, the folded support 121, 131, or 141 may not protrude to the outside as a depressed space is formed in a lower portion of the first plate 120, the second plate 130, or the third plate 140. That is, the supports 121, 131, and 141 do not protrude to the outside of a lower end of the first plate 120, the second plate 130, or the third plate 140 when the support 121, 131, or 141 is folded to abut against the lower surface of the first plate 120 or the second plate 130, and as a result, the plates may overlap each other in parallel.

In addition, handles 132 and 142 are formed in the second plate 130 and the third plate 140, respectively, such that the user may more easily change the arrangements of the plates 120, 130, and 140 by holding the handles 132 and 142.

Meanwhile, although not illustrated, in the present disclosure, an additional plate may of course be further connected to the first plate 120, the second plate 130, or the third plate 140 in the same way as the third plate 140 is connected to the second plate 130.

The heating device 150 may be integrally mounted and included on the first plate 120 so that the user may cook food on the first plate 120 when the case 110, the first plate 120, and the second plate 130 are unfolded. The heating device 150 includes a burner 151 which is disposed on an upper surface of the first plate 120 when the first plate 120 is unfolded, a thermal energy adjusting unit 152 which is disposed at a lateral side of the first plate 120, and a fuel supply tube (not illustrated).

The burner 151 of the heating device 150 is configured to ignite flame when fuel such as gas is supplied. A configuration of a typical portable burner may be applied to the burner 151 of the heating device 150. In FIG. 1, two burners 151 are illustrated, but the present disclosure is not limited to this arrangement, and the burner 151 may be appropriately installed on the first plate 120.

The thermal energy adjusting unit 152 may include a thermal energy adjusting button 152*a* which enables the user to adjust thermal energy of the burner 151, and a safety button 152*b* which is configured to cut off a supply of fuel when the heating device 150 is not used. The thermal energy adjusting button 152*a* and the safety button 152*b* are formed to be pushed or rotated, and a configuration of the portable burner may of course be applied to the thermal energy adjusting button 152*a* and the safety button 152*b*.

The heating device 150 is supplied with fuel such as gas through the fuel supply tube and enables the user to cook food. Specifically, the fuel supply tube of the heating device 150 may be connected to a portable gas tank, and the burner 151 may ignite the supplied fuel so as to heat a cooking container positioned on the burner 151. The portable gas tank connected to the heating device 150 may be a commonly used butane gas tank, and may be a middle-sized or small-sized gas tank. The present disclosure is not particularly limited to the gas tank.

Meanwhile, the kitchen box 100 for camping may further include windshield partitions 153 which are installed at edges of the first plate 120 so as to surround the burner 151.

The windshield partitions 153 may be disposed along four edges of the upper surface of the first plate 120 in order to prevent the flame from the burner 151 of the heating device 150 from flickering or being blown out by the wind. The first plate 120 may have a plurality of grooves so that the windshield partitions 153 may be attached to or detached from the plurality of grooves, and the windshield partitions 153 may be installed by being inserted into the grooves.

A total of four windshield partitions 153 may be provided, and the respective partitions may be formed to be coupled to or separated from each other. In this instance, a height of the windshield partition 153 may be smaller than that of the burner 151 so that the cooking container (e.g., pot) placed on the burner 151 is not caught by the windshield partition 153.

In addition, the kitchen box 100 for camping may further include a covering 154 configured to cover the heating device 150 installed on the first plate 120.

The covering 154 may be configured to enable the user to utilize the first plate 120 after cooking food by using the heating device 150 or to protect the heating device 150 from an external environment. That is, after finishing the cooking, the covering 154 is disposed to cover the first plate 120, such that a space of the first plate 120 may be utilized as a table or the like together with the second plate 130 and the third plate 140, and if it rains during outdoor activity, the covering 154 may prevent water from being introduced into the heating device 150. In this instance, the covering 154 may be formed to have a shape and a size corresponding to a shape and a size of the first plate 120.

The rotary hanger 160 is rotatably connected to the case 110. The rotary hanger 160 is installed to be unfolded in a direction opposite to the direction in which the first plate 120 is unfolded. Specifically, holes 110*b* into which end portions of the rotary hanger 160 may be inserted are formed in the case 110, and the rotary hanger 160 may be rotated by the end portions inserted into the holes 110*b*.

When the rotary hanger 160 is used, the rotary hanger 160 may be rotated and fixed to stand by being supported on one surface of the case 110, but when the rotary hanger 160 is not used, the rotary hanger 160 may be rotated and put into the interior of the case 110. A plurality of S-shaped loops 161 may be provided on the rotary hanger 160. Various cookware such as spoons, forks, and scoops may be hung from the S-shaped loops 161, and various required cookware may be hung from the S-shaped loops 161 when the user uses the heating device 150 of the kitchen box 100 for camping.

Meanwhile, as illustrated in FIGS. 3 and 4, a moving handle 111 may be provided on the case 110. The moving handle 111 may be extended to protrude to the outside of the case 110 or may be retracted and accommodated in the case 110. However, it should be noted that for ease of description, the handle 111 is omitted from FIGS. 1 and 2, but the kitchen box 100 for camping according to the present disclosure is provided with the handle.

In addition, wheels 112 may be provided to be rotatably fixed to the case 110, and the wheels 112 may be fixed to lateral lower end portions of the case 110 and may support the case 110, together with stands 113, with respect to the ground surface.

Arrangement states in which the kitchen box 100 for camping according to the present disclosure is used will be described in detail with reference to FIGS. 1 to 4.

The case 110, the first plate 120, and the second plate 130 may be connected to form a first arrangement (i.e., arrangement illustrated in FIG. 4) in which the first plate 120 covers at least a part of the opening of the case 110 and the second plate 130 overlaps the first plate 120, and a second arrangement (i.e., arrangement illustrated in FIG. 1) in which the first plate 120 does not cover the opening of the case 110 and the first plate 120 and the second plate 130 are unfolded to be parallel to each other.

In addition, the third plate 140 overlaps the second plate 130 when the case 110, the first plate 120, and the second plate 130 form the first arrangement, and the third plate 140 is unfolded to be parallel to the second plate 130 when the case 110, the first plate 120, and the second plate 130 form the second arrangement. When the case 110, the first plate 120, the second plate 130, and the third plate 140 form the first arrangement, only the wheels 112 abut against the ground surface when the moving handle 111 is lifted up, and the user may conveniently draw and move the kitchen box 100 for camping according to the present disclosure. On the contrary, when the case 110, the first plate 120, the second plate 130, and the third plate 140 form the second arrangement, the user may utilize the respective upper surfaces of the case 110, the first plate 120, the second plate 130, and the third plate 140 as cooking and eating spaces.

When the case 110, the first plate 120, the second plate 130, and the third plate 140 form the second arrangement, the supports 121, 131, and 141 support the first plate 120, the second plate 130, and the third plate 140, respectively, so that the case 110, the first plate 120, and the second plate 130 may be supported in parallel with the ground surface. Since the supports 121, 131, and 141 are detachably fixed to the plates 120, 130, and 140, the supports 121, 131, and 141 may not be directly visible from the outside when the case 110, the first plate 120, the second plate 130, and the third plate 140 form the first arrangement as illustrated in FIG. 4.

When the case 110, the first plate 120, the second plate 130, and the third plate 140 form the second arrangement, the first plate 120, the second plate 130, the third plate 140, and the case 110 may be unfolded such that a plane of the first plate 120, a plane of the second plate 130, a plane of the third plate 140, and a plane of the opening of the case 110 are parallel to one another. However, when the ground surface is curved or inclined, it is difficult to arrange the case 110, the first plate 120, the second plate 130, and the third plate 140 so that the opening of the case 110, the first plate 120, the second plate 130, and the third plate 140 are completely parallel to one another, but the case 110, the first plate 120, the second plate 130, and the third plate 140 may be unfolded to be approximately parallel to one another on the ground surface on which the kitchen box 100 for camping according to the present disclosure may be substantially installed and used.

Meanwhile, the kitchen box 100 for camping according to the present disclosure may further include a fourth plate 170 illustrated in FIG. 4.

The fourth plate 170 is installed to overlap the third plate 140 when the case 110, the first plate 120, the second plate 130, and the third plate 140 form the first arrangement in which the case 110, the first plate 120, the second plate 130, and the third plate 140 overlap one another as illustrated in FIG. 4, and the fourth plate 170 is configured to be separated from the third plate 140 when the case 110, the first plate 120, the second plate 130, and the third plate 140 form the second arrangement in which the case 110, the first plate 120, the second plate 130, and the third plate 140 are unfolded as illustrated in FIG. 1. When the fourth plate 170 is installed to overlap the third plate 140 as illustrated in FIG. 4, it is possible to prevent the first plate 120, the second plate 130, and the third plate 140 from being inadvertently unfolded from the case 110, and in the state of the first arrangement, the user may use the fourth plate 170 as a table. However, when the case 110, the first plate 120, the second plate 130, and the third plate 140 are unfolded as illustrated in FIGS. 1, 2, and 3, the fourth plate 170 may be separated from the case 110 and separately stored.

The fourth plate 170 may be detachably installed on the case 110. For example, as illustrated in FIG. 4, when the case 110, the first plate 120, the second plate 130, and the third plate 140 form the first arrangement in which the case 110, the first plate 120, the second plate 130, and the third plate 140 overlap one another, a band member 171, which is formed to extend from the fourth plate 170, is connected to a fixing member 114 formed on a lateral surface of the case 110, and as a result, the fourth plate 170 may be installed and fixed while overlapping the third plate 140.

In this instance, the band member 171 and the fixing member 114 may be configured to be connected and fixed by being coupled by hooks in the same manner as a cable tie is connected. However, the aforementioned connection manner is an illustrative manner, the present disclosure is not necessarily limited to the illustrated configuration, and the fourth plate 170 may of course be fixed while overlapping the third plate 140 in various publicly known manners.

Meanwhile, as illustrated in FIG. 2, the kitchen box 100 for camping according to the present disclosure may further include a bar hanger 180.

The bar hanger 180 may be connected to a groove 120*a* formed in the first plate 120 so as to stand vertically. The bar hanger 180 is installed to enable the user to conveniently hang tools required to cook food and other camping equipment, and the bar hanger 180 is configured such that the user may use the bar hanger 180, as necessary, by installing or separating the bar hanger 180 to or from the first plate 120.

Hereinafter, a kitchen box for camping according to another exemplary embodiment of the present disclosure will be described with reference to the accompanying drawings.

Figure 5:
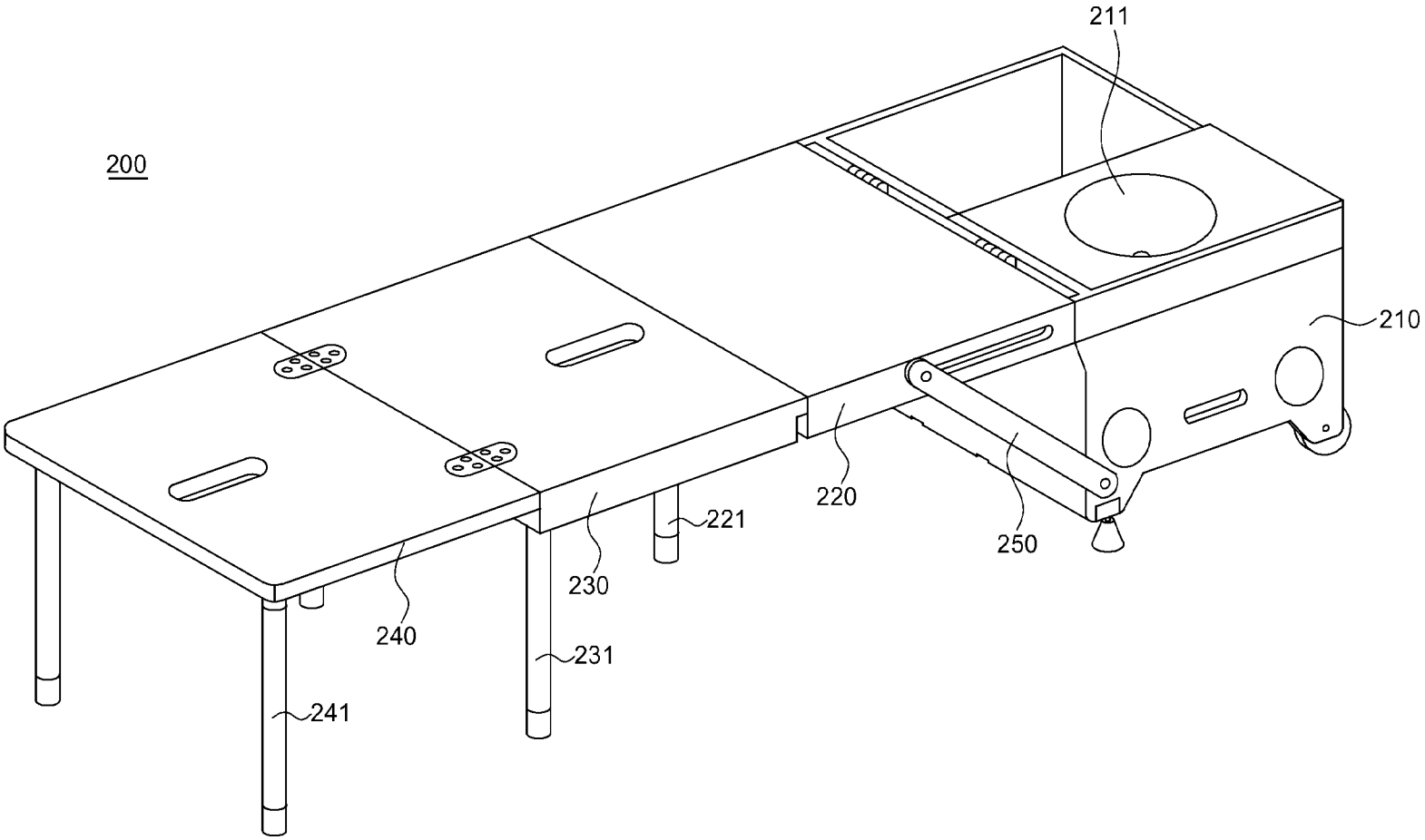
FIG. 5 is a schematic perspective view of a kitchen box for camping according to another exemplary embodiment of the present disclosure.
Figure 6:
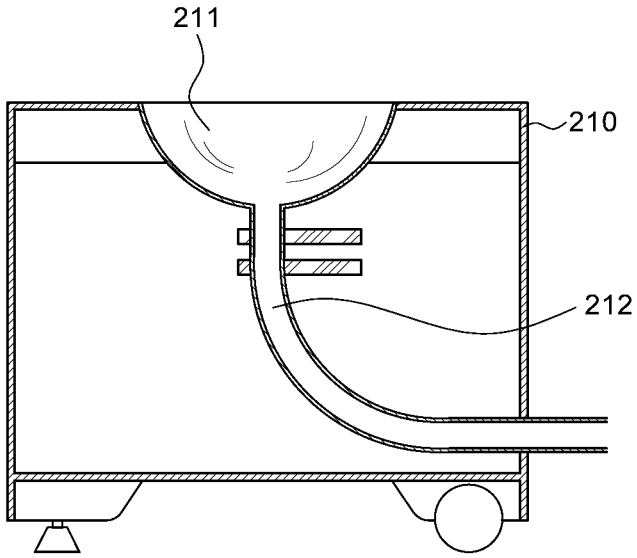
FIG. 6 is a schematic cross-sectional view illustrating a cross section of a case in FIG. 5.

FIG. 5 is a schematic perspective view of a kitchen box for camping according to another exemplary embodiment of the present disclosure, and FIG. 6 is a schematic cross-sectional view illustrating a cross section of a case in FIG. 5.

A kitchen box 200 for camping illustrated in FIG. 5 is different from the kitchen box 100 for camping illustrated in FIGS. 1 through 4 in that the heating device 150 integrally mounted on the first plate 120 is omitted and a sink 211 is detachably installed on a case 210. In addition, the kitchen box 200 for camping is different from the kitchen box 100 for camping in that the kitchen box 200 for camping may further include a slide support 250 which connects and supports a case 210 and a first plate 220. Because other configurations are identical or similar to one another, descriptions of the identical or similar configurations will be omitted to avoid the duplicate descriptions.

The sink 211 is fixed and used at an opening of the case 210, and the sink 211 may be separated from the case 210 and accommodated after the sink 211 is installed and used on the case 210. A conduit 212 is connected to a lower side of the sink 211, and as illustrated in FIG. 6, the conduit 212 may be installed to come out of the case 210 by penetrating a hole separately formed in the case 210. Therefore, the user may conveniently wash foodstuffs or cooking containers by installing the sink 211 on the case 210.

One end portion of the slide support 250, which connects the case 210 and the first plate 220, may be rotatably connected to an outer wall of the case 210, and the other end portion of the slide support 250 may be connected to be slidable along a guide groove formed in the first plate 220. The slide support 250 supports the first plate 220 with respect to the case 210 when the first plate 220 is unfolded from the case 210. Although not illustrated, one end portion of the slide support 250 may be rotatably connected to the first plate 220, and the other end portion of the slide support 250 may be connected to be slidable along a guide groove formed in the case 210.

Meanwhile, other various equipment required for camping may be provided in the case 210. For example, an acoustic device may be installed in the case 210, and a speaker of the acoustic device may be installed to be exposed through a hole separately formed in the case 210. In addition, a charging device may be installed in the case 210. The charging device may be a 12V charging device that is typically used for camping appliances. In addition to the charging device, an electric transformer is provided in the case 210 so that home appliances having various specifications may be used. In addition, various devices such as a lighting device, a mixer, a small-scale refrigerator, a coffee machine, and a burner, which are used for camping, may be freely provided in the case 210.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical spirit in the equivalent scope thereto should be construed as falling within the scope of the present disclosure.

What is claimed is:

1. A kitchen box for camping, comprising:

a case which is formed with an accommodation space therein and has an opening;

a first plate which is rotatably connected to the case so as to cover at least a part of the opening;

a second plate which is rotatably connected to the first plate so as to overlap the first plate;

a third plate which is rotatably connected to the second plate and configured to overlap the second plate;

a fourth plate which is detachably installed on the case and configured to overlap the third plate; and a support which is fixed to one surface of the second plate, wherein the first plate, the second plate, and the case are connected so as to form a first arrangement in which the first plate covers at least a part of the opening and the second plate overlaps the first plate, and a second arrangement in which the first plate does not cover the opening and the first plate and the second plate are unfolded in parallel with each other, planes formed by the first plate, the second plate, and the opening are formed to be parallel to one another when the first plate, the second plate, and the case form the second arrangement, and the support supports the second plate with respect to the ground surface when the first plate, the second plate, and the case form the second arrangement, and wherein the kitchen box further comprises a covering configured to cover the first plate and wherein the covering has a shape and a size corresponding to a shape and a size of the first plate.

2. The kitchen box according to claim 1, further comprising:

a support which is detachably fixed to one surface of the third plate, wherein the third plate overlaps the second plate and the support is separated from the third plate when the case, the first plate, and the second plate form the first arrangement, the third plate is unfolded to be parallel to the second plate when the case, the first plate, and the second plate form the second arrangement, and the support is fixed to the third plate and supports the third plate with respect to the ground surface.

3. The kitchen box according to claim 1, wherein the case is provided with a moving handle which is extended and retracted so as to protrude to the outside of the case or to be accommodated in the case, and wheels which are rotatably fixed.

4. The kitchen box according to claim 1, further comprising:

a heating device which is mounted on the first plate so as to allow a user to cook food on the first plate when the case, the first plate, and the second plate form the second arrangement.

5. The kitchen box according to claim 4, wherein the heating device includes:

one or more burners;

a thermal energy adjusting unit which is configured to adjust thermal energy of the burner; and a fuel supply tube which is connected to a portable gas tank and configured to supply fuel to the burner.

6. The kitchen box according to claim 4, further comprising:

a windshield partition which is installed at an edge of the first plate so as to surround the burner.

7. The kitchen box according to claim 2, wherein the fourth plate overlaps the third plate when the case, the first plate, the second plate, and the third plate form the first arrangement, and the fourth plate is separated from the third plate when the case, the first plate, the second plate, and the third plate form the second arrangement.

8. The kitchen box according to claim 1, further comprising:

a rotary hanger which is rotatably connected to the case so as to be unfolded in a direction opposite to a direction in which the first plate is unfolded when the first plate, the second plate, and the case form the second arrangement.

9. The kitchen box according to claim 1, wherein the case is provided with a sink which is detachably fixed to the case so as to cover at least a part of the opening.

10. The kitchen box according to claim 1, wherein the covering is removable.

11. The kitchen box according to claim 1, wherein the covering is rigid.

12. The kitchen box according to claim 4, wherein the covering is configured to prevent water from being introduced into the heating device.

* * * * *